US006701599B2

(12) United States Patent
Stubler et al.

(10) Patent No.: US 6,701,599 B2
(45) Date of Patent: Mar. 9, 2004

(54) METHOD FOR DEMOUNTING A PRESTRESSING CABLE

(75) Inventors: Jérôme Stubler, Paris (FR); Benoît Lecinq, Paris (FR); Philippe Salmon, Jouy le Moutier (FR)

(73) Assignee: Freyssinet International (STUP) (FR)

( * ) Notice: Subject to any disclaimer, the term of this patent is extended or adjusted under 35 U.S.C. 154(b) by 83 days.

(21) Appl. No.: 10/036,775

(22) Filed: Dec. 21, 2001

(65) Prior Publication Data

US 2002/0113231 A1 Aug. 22, 2002

(30) Foreign Application Priority Data

Dec. 27, 2000 (FR) ..... 00 17109

(51) Int. Cl.[7] ..... B23P 19/027

(52) U.S. Cl. ..... 29/426.4; 29/426.5; 29/407.08; 29/252

(58) Field of Search ..... 29/402.03, 426.4, 29/426.5, 452, 252, 407.08; 254/29 A; 52/223.14

(56) References Cited

U.S. PATENT DOCUMENTS 3,184,219 A * 5/1965 Simms ..... 254/29 A
3,703,030 A * 11/1972 Simms ..... 29/452
3,785,617 A * 1/1974 Friedrich ..... 254/29 A
4,586,303 A 5/1986 Jartoux et al.
4,805,877 A * 2/1989 Hoekstra ..... 254/29 A
5,251,421 A * 10/1993 Friedrich et al. ..... 52/223.14
6,055,691 A * 5/2000 Nutzel et al. ..... 29/452

FOREIGN PATENT DOCUMENTS

EP 0 572 315 12/1993
FR 2 745 829 9/1997

* cited by examiner

*Primary Examiner*—Gregory Vidovich
*Assistant Examiner*—Jermie E. Cozart
(74) *Attorney, Agent, or Firm*—Cantor Colburn LLP

(57) ABSTRACT

The invention addresses the problem of demounting a prestressing cable having a sheath, tendon extending in the sheath and tensioned between two anchoring devices, and a hardened material filling the sheath around the tendons. An energy dissipation device is installed between a zone of the structure and an accessible portion of the cable. The energy dissipation device has a first end applied to a bearing zone and a second end. It is suitable for limiting the force to which it is subjected as a function of the speed of relative displacement between its first and second ends. A first member for retaining the cable is arranged adjacent to the aforesaid portion of the cable. This portion is clamped in a second retaining member engaging the sheath and connected to the second end of the energy dissipation device. The cable can then be severed between the first and second retaining members.

11 Claims, 3 Drawing Sheets

METHOD FOR DEMOUNTING A PRESTRESSING CABLE

BACKGROUND OF THE INVENTION

The present invention relates to a method for the progressive detensioning of a prestressing cable.

The invention relates more particularly to a method allowing the controlled release of the energy accumulated in an external prestressing cable extending within a civil engineering structure along a path in the form of a broken line, the singular points of which consist, in particular, of anchorages or deflectors of the cable.

During checking operations carried out periodically on such civil engineering structures, structural faults in the component elements of the cables are sometimes detected, and it is therefore necessary to carry out their replacement.

Several replacement techniques are generally employed, but they differ according to the type of cable used.

Thus, a distinction is made between cables with non-adhesive injection and cables with adhesive injection.

For the first group of cables, a first technique involves using the extra cable length protruding in the region of the anchorage block in order to attach a tensioning jack. A second technique involves carrying out localized heating successively on each of the wedging pieces in the region of the anchoring head, in order to allow the cable to slip and relax. This second technique is often used when there is no extra cable length (sawn-off anchorage). One disadvantage of this technique is that there is a risk of an abrupt recoil of the anchoring pieces.

For the second group of cables, detensioning usually takes place by means of a heating technique in the running part of the cable (between the singular points) which has previously been stripped of its sheath and of the injection grout.

The main difficulties of this operation are:

- the splashes or emanation of gaseous products during the stripping of the sheath and of the peripheral grout;
- an obstruction of the slipping of the cable along its route;
- possible jamming at the crossings of the singular points of the structure;
- an instantaneous release of the energy stored in the cable in the event of an uncontrolled fracture of the cable, which may occur, in particular, if some strands of the cable are damaged in the region of the working zone, something which is not known beforehand (the remaining strands may break abruptly during the removal of the sheath and of the grout or during heating);
- a whipping of the cable against the structure;
- a considerable recoil of the anchoring pieces.

The uncontrolled fracture of a cable may have serious or even disastrous consequences. Prestressing cables store considerable energies, the abrupt release of which may seriously damage the structure and endanger the safety of the operating personnel.

An object of the present invention is to overcome these disadvantages by providing a safe method for the progressive detensioning of a prestressing cable with adhesive injection.

SUMMARY OF THE INVENTION

Accordingly, the invention provides a method for demounting a prestressing cable of a structure, the cable comprising a sheath, at least one tendon extending in the sheath and tensioned between two anchoring devices, and a hardened material filling the sheath around said at least one tendon.

According to the invention, the method comprises the following steps:

- installing at least one energy dissipation device between a zone of the structure and an accessible portion of the cable, the energy dissipation device having a first end applied to a bearing zone and a second end, and being suitable for limiting the force to which it is subjected as a function of the speed of relative displacement between said first and second ends, said portion of the cable being adjacent to a first member for retaining the cable;
- clamping said portion of the cable in a second retaining member engaging the sheath and connected to the second end of the energy dissipation device; and
- severing the cable between the first and second retaining members.

By virtue of these arrangements, a prestressed cable can be detensioned without risking damaging the civil engineering structure and in complete safety for the user.

In preferred embodiments of the invention, it is possible, where appropriate, to resort to any of the following features:

- anchoring the first retaining member to the structure;
- applying the first end of the energy dissipation device to a bearing zone formed by a zone of the structure, or alternatively by said first retaining member;
- using the energy absorbed by the energy dissipation device when the cable is detensioned responsive to the severing step for driving back the second retaining member in the direction of the position which it occupied before the cable was severed.

According to another aspect of the invention, using a cable detensioning method of the above-mentioned type, there is provided a device for demounting a prestressing cable of a structure, the cable comprising a sheath, at least one tendon extending in the sheath and tensioned between two anchoring devices, and a hardened material filling the sheath around said at least one tendon. According to the invention, the device comprises at least one energy dissipation device having a first end to be applied to a bearing zone and a second end, and being suitable for limiting the force to which it is subjected as a function of the speed of relative displacement between said first and second ends, and a second retaining member connected to the second end of the energy dissipation device, in order to engage the cable sheath in an accessible portion thereof located adjacent to a first member for retaining the cable.

In preferred embodiments of the demounting device, it is possible, where appropriate, to resort to any of the following features:

- the energy dissipation device comprises at least one hydraulic cylinder/piston system extending between the second retaining member and the bearing zone, the demounting device further comprising a circuit for bringing towards an accumulator chamber a hydraulic fluid expelled in response to the relative displacement between the piston and the cylinder, said circuit comprising a flow-limiting member;
- the accumulator chamber houses a first fluid brought to the accumulator chamber in response to the relative displacement between the piston and the cylinder and a second, gaseous fluid, and comprises a free surface separating said first and second fluids to ensure equilibrium between the pressure of said first and second fluids;

the energy dissipation device limits the hydraulic fluid being transferred between the cylinder and the accumulator chamber;

the second retaining member comprises a jaw having a clamping capacity of up to 40 tons.

DESCRIPTION OF PREFERRED EMBODIMENTS

In the various figures, the same references designate identical or similar elements.

Figure 1:
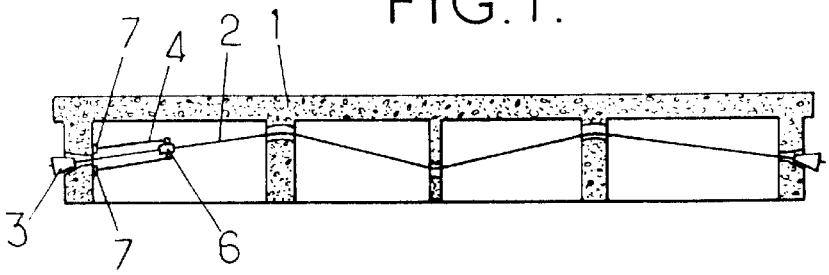
FIGS. 1, 1*a*, 1*b* are side elevation views of a civil engineering structure provided with at least one energy dissipation device for a prestressing cable.

FIG. 1 illustrates a civil engineering structure 1, in which at least one external prestressing cable 2 travels along a route in the form of a broken line, the singular points of which consist, in particular, of anchorages 3 or deflectors of the cable.

Figure 1A:
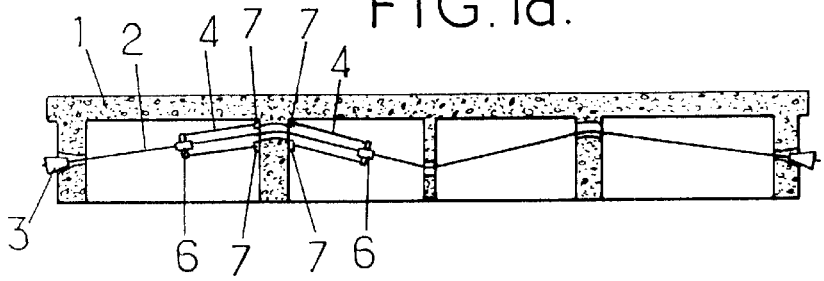
Figure 1B:
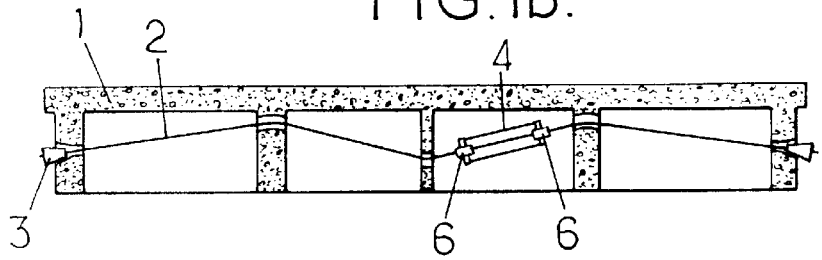

FIGS. 1, 1*a* and 1*b* illustrate various possible configurations for the integration of a device for demounting a prestressing cable. Thus, in FIG. 1, the demounting device comes to bear on a zone of the structure which is adjacent to one of the anchorages 3. In FIG. 1*a*, two demounting devices are mounted on either side of a zone of the structure which comprises a cable deflector. In FIG. 1*b*, a demounting device is installed on a free portion of the cable.

Figure 2:
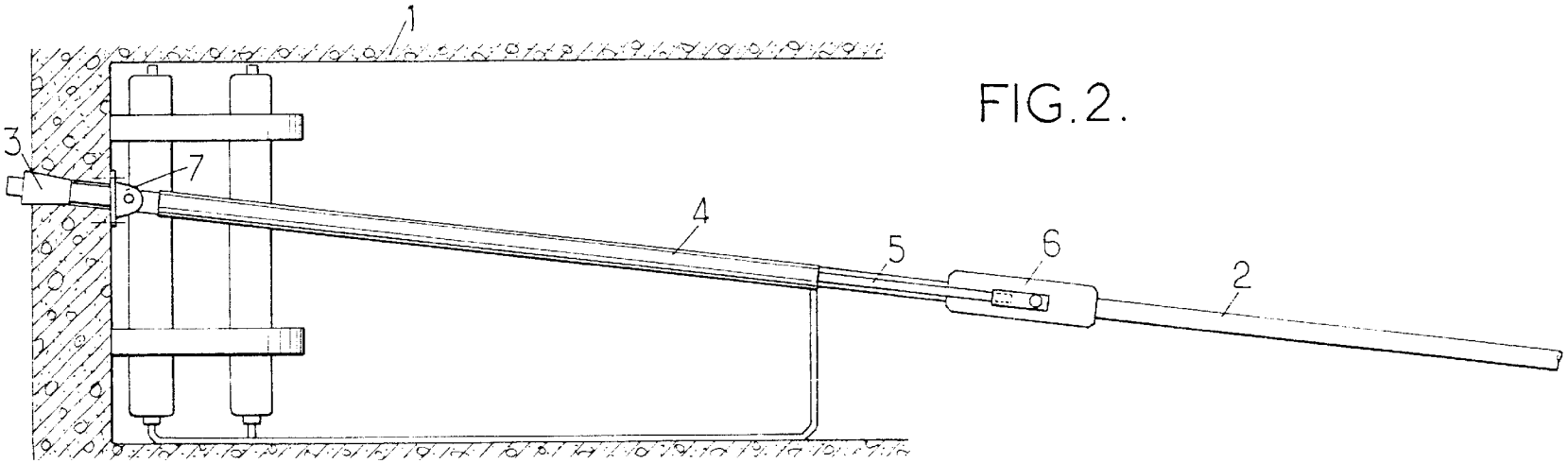
FIG. 2 is a sectional and side elevation view of the demounting device before the severing of the cable.
Figure 3:
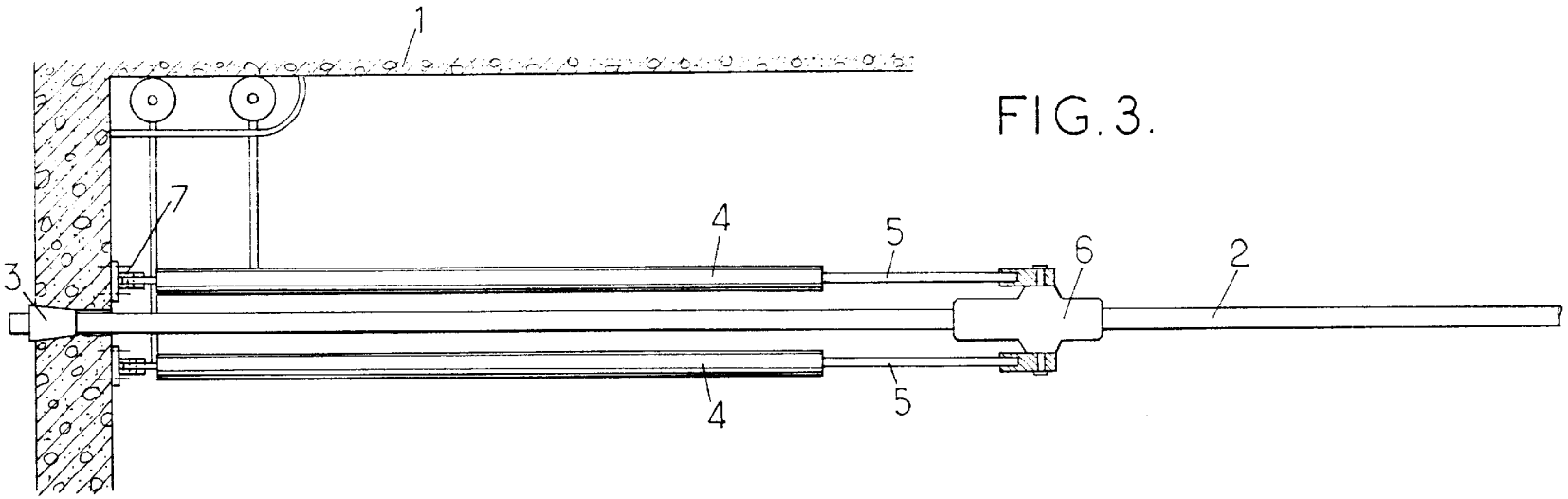
FIG. 3 is a sectional and plane elevation view of FIG. 2.

FIGS. 2 and 3 illustrate the demounting device used, particularly in FIG. 1 or 1*a*, in its initial configuration before the detensioning of the cable 2.

This device consists of a hydraulic cylinder/piston system forming an energy dissipation member. It will be appreciated that several such devices could also be used. The end of the body of the cylinder 4 is mounted, preferably in an articulated manner, on a support 7 positioned in the region of a bearing zone on the structure 1, whilst the free end of the piston 5 is attached to a portion of the sheath of the cable 2 by means of a jaw 6. Another member for retaining the cable is positioned in the vicinity of the bearing zone so as to prevent the cable from escaping; this may be, for example, an anchoring point.

In the example illustrated in FIGS. 2 and 3, a double cylinder/piston system is used, which is mounted in parallel on each side of the cable 2 along a plane containing the longitudinal axis of the cable 2, the free end of each of the pistons 5 cooperating in the region of the same jaw 6.

In this initial configuration, in which the prestressing cable 2 is tensioned between two singular points of the structure, each of the pistons 5 is retracted into the body of the respective cylinder 4, the volumes of each of the cylinders then being filled with a hydraulic fluid.

Figure 4:
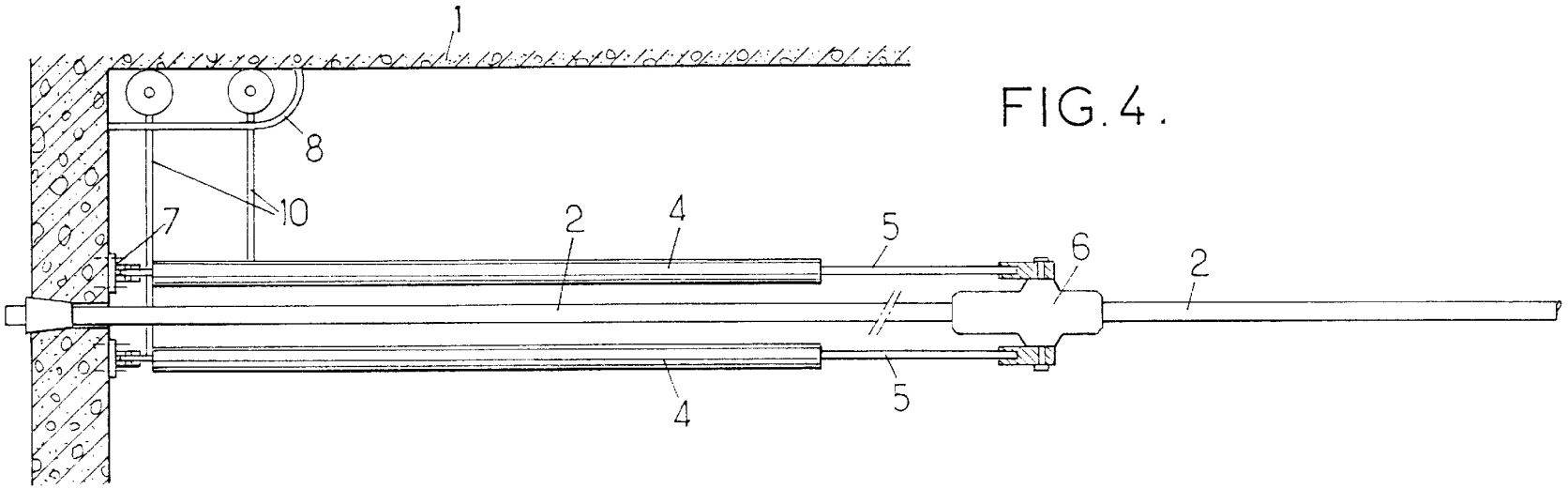
FIG. 4 is a sectional and side elevation view of the demounting device, illustrating the phase of severing the cable.

FIG. 4 illustrates the configuration of the demounting device at the moment when the severing of the cable 2 is carried out. This severing takes place at any location between the bearing zone and the jaw. At this moment, the prestressing cable is no longer held and relaxes in a controlled manner by virtue of the counterpressure exerted by the hydraulic fluid on the pistons 5.

Figure 6:
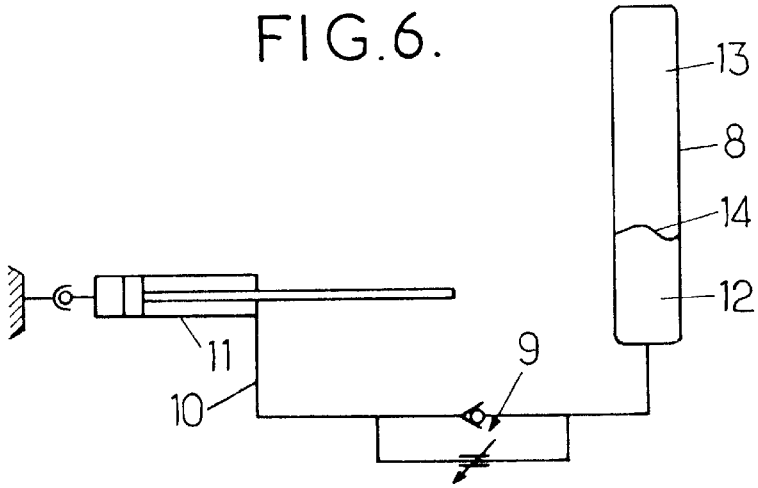
FIG. 6 is a view illustrating the hydraulic diagram of the installation.

Each of the cylinder bodies comprises outlet ports 11 connected by means of conduits or the like to an accumulator chamber 8 (illustrated in FIG. 6). On the conduits 10 connecting this accumulator chamber 8 to the cylinders 4, there is provision for arranging a certain number of members 9 making it possible to control the flow of circulating hydraulic fluid and thus making it possible to control or adjust the stroke of the piston 4, particularly during the phase of the progressive detensioning of the prestressing cable 2.

Figure 5:
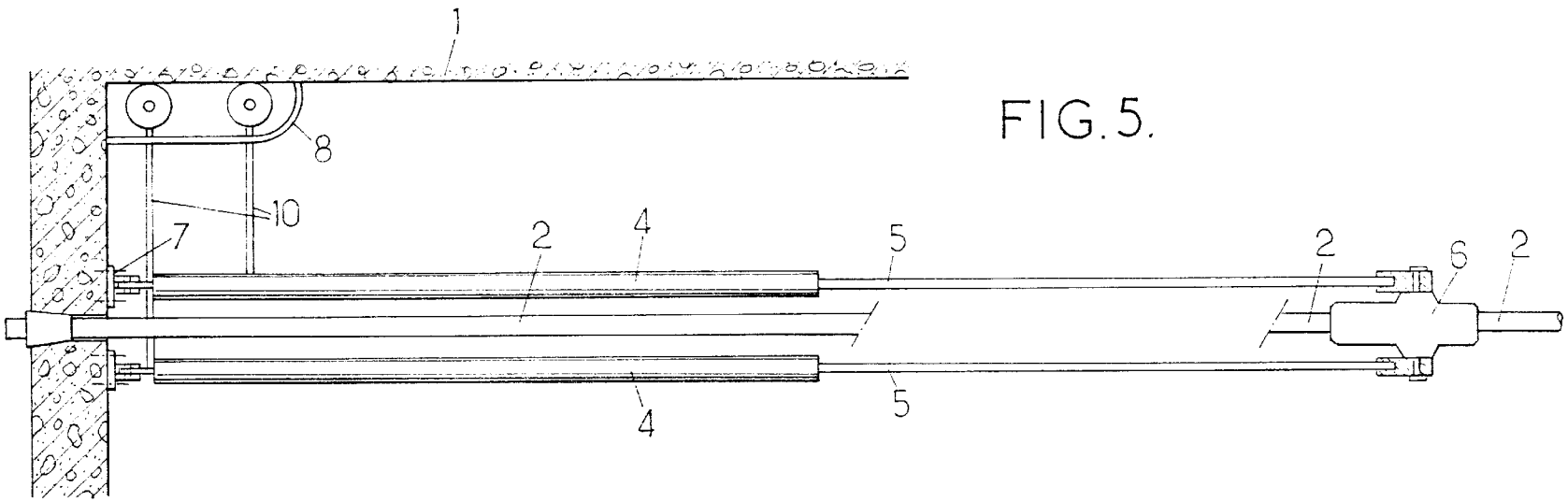
FIG. 5 is a sectional and side elevation view of the demounting device after the severing of the cable.

This phase, illustrated in FIG. 5, shows the position of the demounting device when the prestressing cable is detensioned; the pistons are extended from the bodies of the cylinders, and their stroke has been controlled by limiting the flow of hydraulic fluid escaping from the cylinders through the conduits 10 and the members 9 towards the accumulator chamber 8 under the effect of the displacement of the pistons as a result of the tensile forces coming from the cable 2.

The adjustment of the members 9 is carried out as a function of the detensioning of the cable which varies according to the inherent characteristics of the cable (cable section, number of strands or tendons, type of material forming the cable, length of cable located between two singular points, prestressing strength, etc.).

The distance corresponding to the displacement of the second retaining member is likewise a function of the characteristics of the cable and of the construction of the civil engineering structure.

The accumulator chamber 8 consists of a chamber comprising two cavities 12, 13 separated by a free surface 14. Each of the cavities comprises a fluid separated by a free surface which ensures the equilibrium between the pressure of the hydraulic fluid issuing into the accumulator chamber and the pressure of the second gaseous fluid.

The hydraulic fluid which is expelled during the progressive detensioning of the cable fills the accumulator chamber 8, at the same time compressing the second gaseous fluid 13.

The energy thus accumulated by the second fluid is restored in order to make it possible to drive back the pistons 5 in their respective cylinders 4 (cf. FIGS. 2 and 3) and the jaws 6 in the direction of the position which they occupied before the cable was severed.

In an alternative embodiment of the demounting device, the bearing zone does not consist of an element of the construction of the civil engineering structure, but of a fastening point on another portion of the sheath of the cable. In this case, two retaining members are used, mounted face to face on the prestressing cable, these are connected by means of a double cylinder/piston system similar to the preceding one, severing is carried out at any point located between the two jaws, and the displacement of the pistons in relation to the cylinders is limited by controlling the flow of circulating hydraulic fluid by means of the flow-limiting members 9.

Another variant, likewise not illustrated in the figures, may involve substituting for the piston/cylinder system an energy dissipation device consisting, for example, of a braked winch unwinding under the effect of the detensioning of the cable.

The invention, as described above, affords many advantages:

the use of an energy dissipation device with controllable displacement makes it possible to demount prestressing cables under optimum safety conditions and therefore makes it easier to replace these cables with a view to the preventive maintenance of structures;

the use of the energy dissipation device leads to a limited force, thus allowing a simplification of the anchoring device. Moreover, it can be reused on other structures.

We claim:

1. A method for demounting a prestressing cable of a structure, the cable comprising a sheath, at least one tendon extending in the sheath and tensioned between two anchoring devices, and a hardened material filling the sheath around said at least one tendon, the method comprising the steps of:

installing at least one energy dissipation device between a zone of the structure and an accessible portion of the cable, the energy dissipation device having a first end applied to a bearing zone and a second end, said portion of the cable being adjacent to a first member for retaining the cable;

clamping said portion of the cable in a second retaining member engaging the sheath and connected to the second end of the energy dissipation device; and severing the cable between the first and second retaining members.

2. A method according to claim 1, further comprising the step of anchoring the first retaining member to the structure.

3. A method according to either claim 1, further comprising the step of applying the first end of the energy dissipation device to a bearing zone formed by a zone of the structure.

4. A method according to claim 1, further comprising the step of applying the first end of the energy dissipation device to a bearing zone formed by said first retaining member.

5. A meted according to claim 1, wherein the energy absorbed by the energy dissipation device when the cable is detensioned responsive to the severing step is used for driving back the second retaining member in the direction of the position occupied by said second retaining member before the cable was severed.

6. A method according to claim 1, wherein the energy dissipation device comprises at least one hydraulic cylinder/piston system extending between the second retaining member anti the bearing zone, and wherein a circuit is provided for bringing towards an accumulator chamber, a hydraulic fluid expelled in response to relative displacement between the piston and the cylinder, said circuit comprising a flow-limiting member.

7. A method according to claim 6, wherein the accumulator chanter houses a first fluid brought to the accumulator chamber in response to the relative displacement between the piston and the cylinder and a second, gaseous fluid, and comprises a free surface separating said first and second fluids to ensure equilibrium between the pressure of said first and second fluids.

8. A method according to claim 6, wherein the energy dissipation device limits the hydraulic fluid being transferred between the cylinder and the accumulator chamber.

9. A method according to claim 6, wherein the second retaining member comprises a jaw having a clamping capacity of up to 40 tons.

10. A method according to claim 1, wherein the energy dissipation device comprises means for limiting a force to which said device is subjected as a function of the speed of relative displacement between said first and second ends.

11. A method according to claim 10, wherein the force limiting means comprise hydraulic means.

* * * * *